US012392215B2

(12) United States Patent
Duran et al.

(10) Patent No.: US 12,392,215 B2
(45) Date of Patent: Aug. 19, 2025

(54) HYBRID DISSOLVABLE PLUG WITH IMPROVED DRILLABILITY

(71) Applicant: G&H Diversified Manufacturing LP, Houston, TX (US)

(72) Inventors: Frank Duran, Houston, TX (US); Timmothy Lee, Tomball, TX (US); Manuel Morales, Houston, TX (US); Ryan Ward, Tomball, TX (US); Steven Zakharia, Houston, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 0 days.

(21) Appl. No.: 18/224,966

(22) Filed: Jul. 21, 2023

(65) Prior Publication Data

US 2024/0026748 A1 Jan. 25, 2024

Related U.S. Application Data

(60) Provisional application No. 63/391,733, filed on Jul. 23, 2022.

(51) Int. Cl.

| | |
|---|---|
| ***E21B 33/129*** | (2006.01) |
| ***E21B 33/12*** | (2006.01) |
| ***E21B 33/128*** | (2006.01) |

(52) U.S. Cl.
CPC ..... *E21B 33/1293* (2013.01); *E21B 33/1204* (2013.01); *E21B 33/128* (2013.01); *E21B 2200/08* (2020.05)

(58) Field of Classification Search
CPC ..... E21B 33/128; E21B 2200/08
See application file for complete search history.

(56) References Cited

U.S. PATENT DOCUMENTS

| | | | | |
|---|---|---|---|---|
| 2018/0179851 | A1* | 6/2018 | Davies | E21B 23/01 |
| 2021/0054719 | A1* | 2/2021 | Nichols | E21B 34/12 |

* cited by examiner

*Primary Examiner* — Tara Schimpf
*Assistant Examiner* — Ursula Lee Norris
(74) *Attorney, Agent, or Firm* — Conley Rose, P.C.

(57) ABSTRACT

A frac plug is disclosed that is used for isolating a lower portion of a wellbore from an upper portion to enable a fracking process on newly created perforations in casing or liner pipe where the frac plug is particularly designed rapid drill out after all the fracking operations have been completed. The frac plug includes arrangements for holding the polymer or rubber element from rotation as the plug is being drilled. One arrangement includes pins that lock the polymer element to the bottom cone. In another, the polymer element is simply bonded by adhesive to the faceted cone. The facets on the cone prevent the cone from rotating in the wellbore by being pressed against the flat bottom slip segments that remain locked to the casing or liner pipe.

15 Claims, 6 Drawing Sheets

HYBRID DISSOLVABLE PLUG WITH IMPROVED DRILLABILITY

CROSS-REFERENCE TO RELATED APPLICATIONS

This application claims benefit of U.S. provisional patent application Ser. No. 63/391,733 filed Jul. 23, 2022, and entitled "Hybrid Dissolvable Plug with Improved Drillability," which is hereby incorporated herein by reference in its entirety for all purposes.

STATEMENT REGARDING FEDERALLY SPONSORED RESEARCH OR DEVELOPMENT

Not applicable.

BACKGROUND

Hydrocarbon producing wellbores are typically created by drilling a wellbore into a promising formation and creating fluid conductivity between the formation and the wellbore. In many applications, the wellbore is supported by a tubular casing string (also referred to simply as "casing") which extends to the downhole end or toe of the wellbore. Cement is typically pumped into the annulus formed around the casing along the sidewall of the wellbore. The cement secures and seals the casing string to the wellbore and holds the wellbore open along the length of the casing. The casing string may then be perforated along the promising formation, typically at a great number of separate locations to provide extensive fluid communication into the interior of the casing string whereby hydrocarbons may flow uphole and be produced at the surface. In most applications, the formation is made more productive by stimulating the promising formation prior to producing hydrocarbons therefrom. For example, a hydraulic fracturing or "fracking" operation may be performed to frack the perforations to enlarge and extend channels of fluid communication deeper into the promising formation extending away from the casing, enhancing the fluid conductivity between the formation and the wellbore. However, the process of fracking is typically best accomplished by fracking a moderate number of perforations at one time and a downhole "frac" plug is used to provide zonal isolation of selected groups of perforations.

For example, perforating is typically accomplished by deploying a wireline suspended, "plug-and-perf" toolstring into the casing to a first desired location deep within the wellbore. Once at the desired location, a plug (often referred to as a "frac plug") located at a downhole end of the toolstring is activated or "set" in place whereby one or more slips of the frac plug extend outwards and bite into the inside of the casing string to secure the frac plug to the casing string at the desired location. As the one or more slips attach to the casing string, a sealing element or "packer" of the frac plug is squeezed end-to-end by one or more extrusion rings of the frac plug to thereby bulge and expand the sealing element outwardly toward the inside of the casing string to provide a hydraulic seal within the casing string isolating the portion of the wellbore extending uphole from the set frac plug from the portion of the wellbore extending downhole from the set frac plug. Generally, the process of setting the plug also results in the frac plug disconnecting from the plug-and-perf toolstring so that one or more perforating guns (sometimes referred to as "perf guns") of the toolstring may be progressively retrieved uphole through the wellbore and fired as the perf guns arrive at desired positions for perforating the casing string.

After the plug-and-perf toolstring has completed its task and has been retrieved from the wellbore, the new perforations formed by the toolstring are then subjected to the fracking operation whereby fracturing fluid is pumped into the wellbore from the surface to pressurize the portion of the wellbore extending uphole from the set frac plug to a fluid pressure sufficient to expand and extend the channels located beyond the perforations and within the promising formation. With the slips of the frac plug set in the casing string to resist movement along the casing string and the sealing element preventing fluid from bypassing the plug, already fracked perforations located downhole from the set frac plug are isolated from further fracking by the set plug. In this manner, plugging off the already fracked perforations permits the pressure to increase in the uphole portion of the wellbore to relatively high predefined fluid pressures where the fracturing fluid would be inclined to drain away through the already fracked perforations if frac plugs were not already set. This plug-and-perf and fracking operation may be repeated numerous times where the wellbore is repeatedly divided by other frac plugs that isolate subsequent uphole portions from the last portion of the wellbore to be perforated. In this manner, multiple plugs with many fracked perforations continually stack up in the wellbore as each latest plug is set.

Once all of the perforations have been created and fracked, the plurality of set frac plugs are removed to re-open the wellbore and thereby prepare the wellbore for hydrocarbon production. In some applications, the frac plugs are made of corrodible or dissolvable materials that hold the seal for at least a week but decompose to flushable debris. However, such corrodible or dissolvable materials tend to make such plugs relatively expensive compared to other plugs not incorporating such materials. Some proposals for plugs to address this issue include forming them from a combination of robust materials with certain components made of the corrodible or dissolvable material. Such proposals do not excessively increase the plug costs but may reduce the time needed for drilling out the plugs.

In addition, one difficulty encountered while drilling out set frac plugs is having components catch in the teeth of the drill bit such that the components free spin in concert with the spinning bit. Drilling is a significantly more effective when the obstruction is fixed and the teeth cut through the obstruction. Having a nose of the set plug bound up in the teeth of the drill may essentially prevent the sharp and aggressive teeth from doing what they are designed to do.

In addition to the nose, another component that is seen to be troubling is the sealing element that is made of a rubber or polymer that should be easily cut up if it were held down in place. However, in practice, the polymer sealing element may bounce around in front of the downward progressing and rotating drill bit, only to cut a chunk or two off every time the bit catches back up to it. As the debris of the sealing element is washed uphole through the annulus formed between the coiled tubing and the casing, they may drag on the coiled tubing attached to the drill bit and thereby bind up the drilling system. If the debris of the sealing element have a minimum diameter that fills the annulus space, trouble and delays are likely. Particularly, multiple debris can bind up the coiled tubing causing drilling to stop and the coiled tubing to be pulled back or pulled out which quickly gets very costly.

The industry would welcome any technology or technique that would more rapidly and effectively grind up the bits and pieces of the plugs after a fracking operation is completed.

SUMMARY OF THE DISCLOSURE

The disclosure more particularly relates to a plug that is configured to be deployable down into a hydrocarbon wellbore as part of a tool string to isolate a lower portion of the wellbore from an upper portion of the wellbore. The plug has an axis and a longitudinal direction extending with the axis such that the axis of the plug is suited for being oriented with a central bore of the wellbore. The plug includes an annular sealing element that is arranged to extend radially outwardly toward the inside of the wellbore when compressed in the longitudinal direction and a downhole slip assembly that is arranged to lock against the inside of the wellbore when it is compressed longitudinally. The downhole slip assembly further includes an extrusion ring and a slip member or belt where the extrusion ring has a ramp-like shape arranged to move the slip belt outwardly toward the inside of the wellbore by riding up on the ramp-like shape while being compressed longitudinally where the slip belt has an outer face oriented to face toward the inside of the wellbore and one or more engagement members located on the outer face of the slip belt. The plug is further configured such that the annular sealing element and the extrusion ring are arranged together such that one may not rotate independent of the other about the axis of the plug.

In an embodiment, a plug deployable into a wellbore extending through a subterranean earthen formation to isolate a downhole section of the wellbore from an opposing uphole section of the wellbore is disclosed. In this embodiment, the plug includes an annular sealing element extending between a pair of longitudinally opposed ends and configured to extend radially outwards into sealing engagement with a wall of the wellbore in response to the plug transitioning from a run-in configuration to a set configuration, and a slip assembly coupled to the sealing element and configured to attach to the wall of the wellbore in response to the plug transitioning from a run-in configuration to a set configuration, wherein the slip assembly comprises one or more radially displaceable slip members and an extrusion ring having an inclined radially outer surface configured to drive the one or more slip members radially outwards and into engagement with the wall of the wellbore in response to the plug transitioning from a run-in configuration to a set configuration, wherein the extrusion ring is rotationally locked to one of the pair of longitudinally opposed ends of the sealing element with respect to a central axis of the plug.

In an embodiment, another plug deployable into a wellbore extending through a subterranean earthen formation to isolate a downhole section of the wellbore from an opposing uphole section of the wellbore is disclosed. In this embodiment, the plug includes an annular sealing element extending between a pair of longitudinally opposed ends and configured to extend radially outwards into sealing engagement with a wall of the wellbore in response to the plug transitioning from a run-in configuration to a set configuration, a slip assembly coupled to the sealing element and configured to attach to the wall of the wellbore in response to the plug transitioning from a run-in configuration to a set configuration, wherein the slip assembly comprises one or more radially displaceable slip members and an extrusion ring having an inclined radially outer surface configured to drive the one or more slip members radially outwards and into engagement with the wall of the wellbore in response to the plug transitioning from a run-in configuration to a set configuration, and one or more connectors radially spaced from a central axis of the plug, each of the one or more connectors extending from a first end coupled with and contacting the sealing element and a second end coupled with and contacting the extrusion ring of the slip assembly.

In an embodiment, another plug deployable into a wellbore extending through a subterranean earthen formation to isolate a downhole section of the wellbore from an opposing uphole section of the wellbore is disclosed. In this embodiment, the plug includes an elongate mandrel extending between a longitudinal uphole end and a longitudinal downhole end, an annular sealing element positioned along a radially outer surface of the mandrel and configured to extend radially outwards into sealing engagement with a wall of the wellbore in response to the plug transitioning from a run-in configuration to a set configuration, a slip assembly positioned along the radially outer surface of the mandrel and configured to attach to the wall of the wellbore in response to the plug transitioning from a run-in configuration to a set configuration, wherein the slip assembly comprises one or more radially displaceable slip members and an extrusion ring having an inclined radially outer surface configured to drive the one or more slip members radially outwards and into engagement with the wall of the wellbore in response to the plug transitioning from a run-in configuration to a set configuration, and one or more connectors positioned radially outwards from and external the mandrel, each of the one or more connectors coupled between the sealing element and the extrusion ring of the slip assembly.

BRIEF DESCRIPTION OF THE DRAWINGS

A more complete understanding of the present disclosure may be obtained from the following detailed description with reference to the attached drawing figures as summarized below, in which.

DETAILED DESCRIPTION

Figure 1:
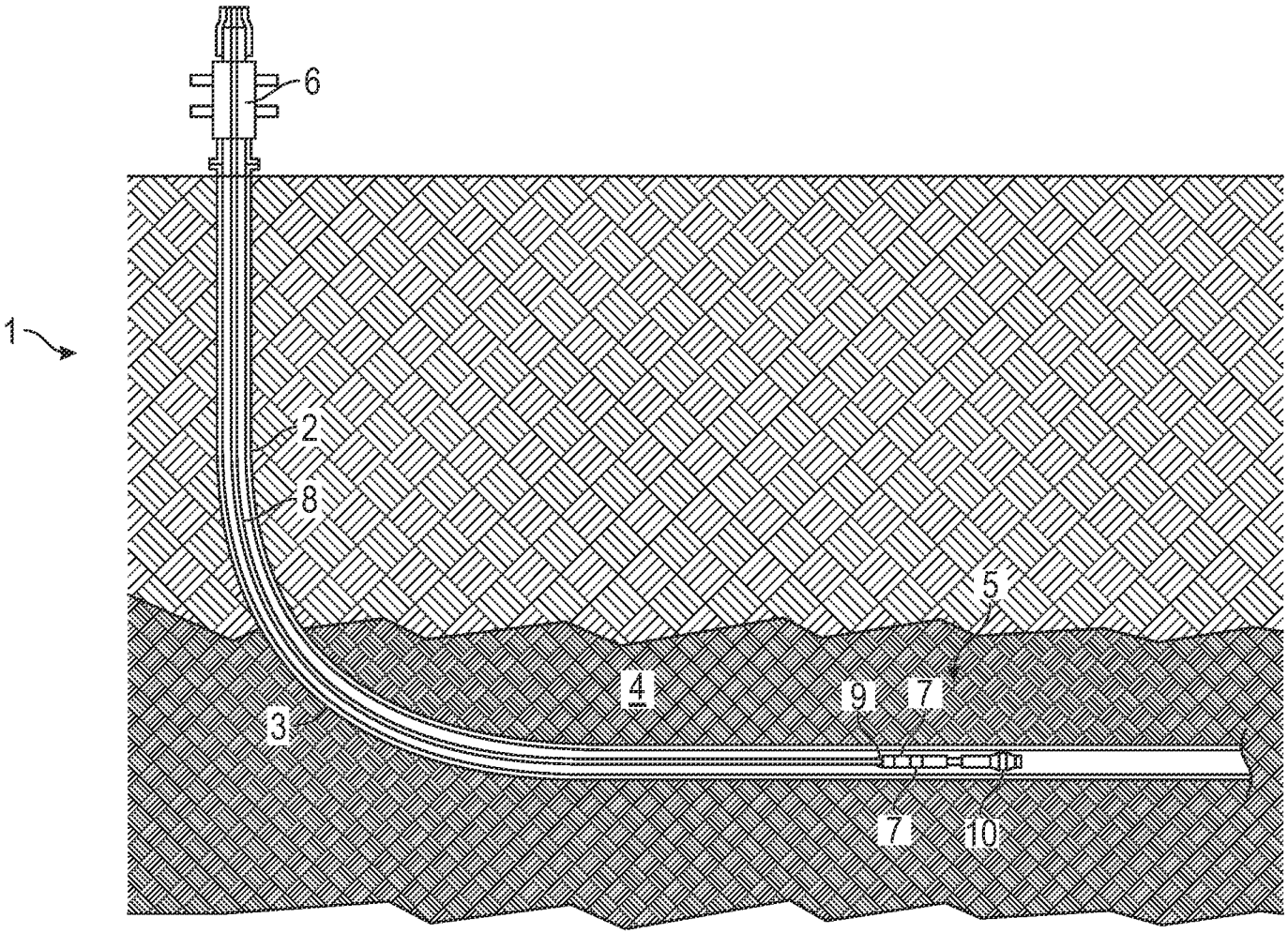
FIG. 1 is a schematic view of a toolstring being deployed into a wellbore according to some embodiments.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

Referring initially to FIG. 1, a wireline system 1 is shown for deploying a toolstring 5 into casing 2 of a wellbore 3 extending into an earthen subterranean formation. Toolstring 5 is generally configured for performing a plug and perforating ("plug-and-perf") operation and thus may also be referred to herein as plug-and-perf toolstring 5. Casing (e.g., casing 2 shown in FIG. 1) may be referred to as a casing string or as liner pipe. Casing 2 generally comprises a string of pipe that joined together end-to-end and inserted into wellbore 3 to both keep the wellbore 3 open (e.g., provide structural support to wellbore 3) and to seal the wellbore 3 from the subterranean formation. Casing 2 extends from the surface far into the Earth and into an extended generally horizontal run within a prospective hydrocarbon bearing formation 4 present within the Earth. It may be understood that prior to inserting toolstring 5 into casing 2, a surface crane (not shown in FIG. 1) positioned adjacent to an uphole end of the casing 2 may be utilized for vertically lifting the toolstring 5 above a surface assembly 6 (only partially shown in FIG. 1 and including, e.g., a wellhead, a valve tree) such that the toolstring 5 may be vertically lowered and run through the surface assembly 6 and into the uphole end of the casing 2.

The toolstring 5 of wireline system 1 includes a number of tools that are selected by an operator of the casing 2. In this exemplary embodiment, toolstring 5 generally includes, among other components, a downhole or frac plug 10 at a downhole end thereof, one or more perforating guns 7, and a hydraulic release tool 9 located at an uphole end thereof. It may be understood that toolstring 5 may include additional components not shown in FIG. 1 such as, for example, tools for providing pressure isolation and/or electrical communication across the toolstring 5, as well as a setting tool for setting the plug 10 within the casing 2. As will be described further herein, hydraulic release tool 9 attaches to a wireline 8 suspended from the surface. Particularly, wireline 8 extends from a wireline truck of the surface assembly 6, and is typically quite long to permit the toolstring 5 to run potentially miles down into the casing 2. It may be generally understood that many wellbores extend vertically downwards from the surface and then deviate along a broad curve to a generally horizontal section that typically extends a great length (e.g., miles) horizontally through a hydrocarbon bearing zone (e.g., formation 4 shown in FIG. 1).

As shown in FIG. 1, toolstring 5 is lowered and typically pumped down to a generally horizontal section of casing 2 where the wellbore 3 extends a significant distance along within a hydrocarbon bearing formation 4. At a desired location in the casing 2, the plug 10 of toolstring 5 is actuated from a run-in configuration to a set configuration to seal against an inner surface of the casing 2 to isolate an uphole portion of the casing 2 (e.g., the portion of casing 2 extending uphole from the set plug 10) from a downhole portion below the plug 10 (e.g., the portion of casing 2 extending downhole from the set plug 10). The plug 10, once set, prevents fracturing fluid pumped into casing 2 from surface assembly 6 from entering previously fracked perforations formed in the casing 2 and located downhole from the set plug 10. In other words, plug 10, once set, forces the fracturing fluid into newly created perforations (e.g., formed by the one or more perforating guns 7 of toolstring 5) located uphole from the set plug 10, permitting the desired buildup of fluid pressure in the uphole portion of casing 2 sufficient to fracture the newly created perforations.

It may be understood that significant hydraulic pressure is required to enlarge and extend new perforations so plug-and-perf operations typically begin by plugging off the existing downhole perforations (e.g., the perforations which have already been fracked using fracturing fluid) by setting the plug 10 at a desired location in the casing 2 uphole from the downhole perforations, and separating the set plug 10 from the remainder of the toolstring 5 so that new perforations may be created in the casing 2 uphole from the set plug 10. In some instances, once the plug 10 is disengaged from the toolstring 5, the toolstring 5 may lay on a vertical bottom (relative to the direction of gravity) of the horizontal run of the casing 2. From this position, the toolstring 5 may be pulled uphole toward the surface by the wireline 8 (which is retracted at the surface) while each of a number of perf guns 7 are detonated at predetermined positions to detonate shaped explosive charges thereof which puncture the casing 2 thereby creating new perforations therein.

As described above, in some instances the toolstring 5 may become stuck within the casing 2 before being retrieved to the surface via the wireline 8. For example, the remains of the perforating guns 7 (still attached to the toolstring 5) after firing of the guns 7 may catch against a casing joint along the casing 2. As just one example, a piece of shrapnel of one of the fired perforating guns 7 may catch into a groove formed in a casing joint of the casing 2, causing the remains of the fired perforating gun 7 to become stuck against the respective casing joint and preventing further uphole travel of the toolstring 5 through the casing 2. While it is generally preferred to always retrieve the toolstring and efforts will be taken to try to dislodge the stuck tool, in such instances, the hydraulic release tool 9 of toolstring 5 may be activated to separate the stuck toolstring 5 from the wireline 8, permitting the wireline 8 to be conveniently and quickly retrieved to the surface with the stuck toolstring 5 remaining in the casing 2. Later, at least a portion of the stuck toolstring 5 may be drilled out or otherwise broken up within the casing 2 into flow-transportable debris that may be washed uphole from the casing 2. In this manner, operators of wireline system 1 may avoid the undesirable need of obtaining a fishing rig in an attempt to fish the stuck toolstring 5 from the casing 2, an unpredictable process which may take days or weeks before the stuck toolstring 5 may be successfully retrieved from the casing 2, with the extended downtime resulting from the fishing operation increasing the overall costs associated with placing the wellbore 3 into production.

Figure 2:
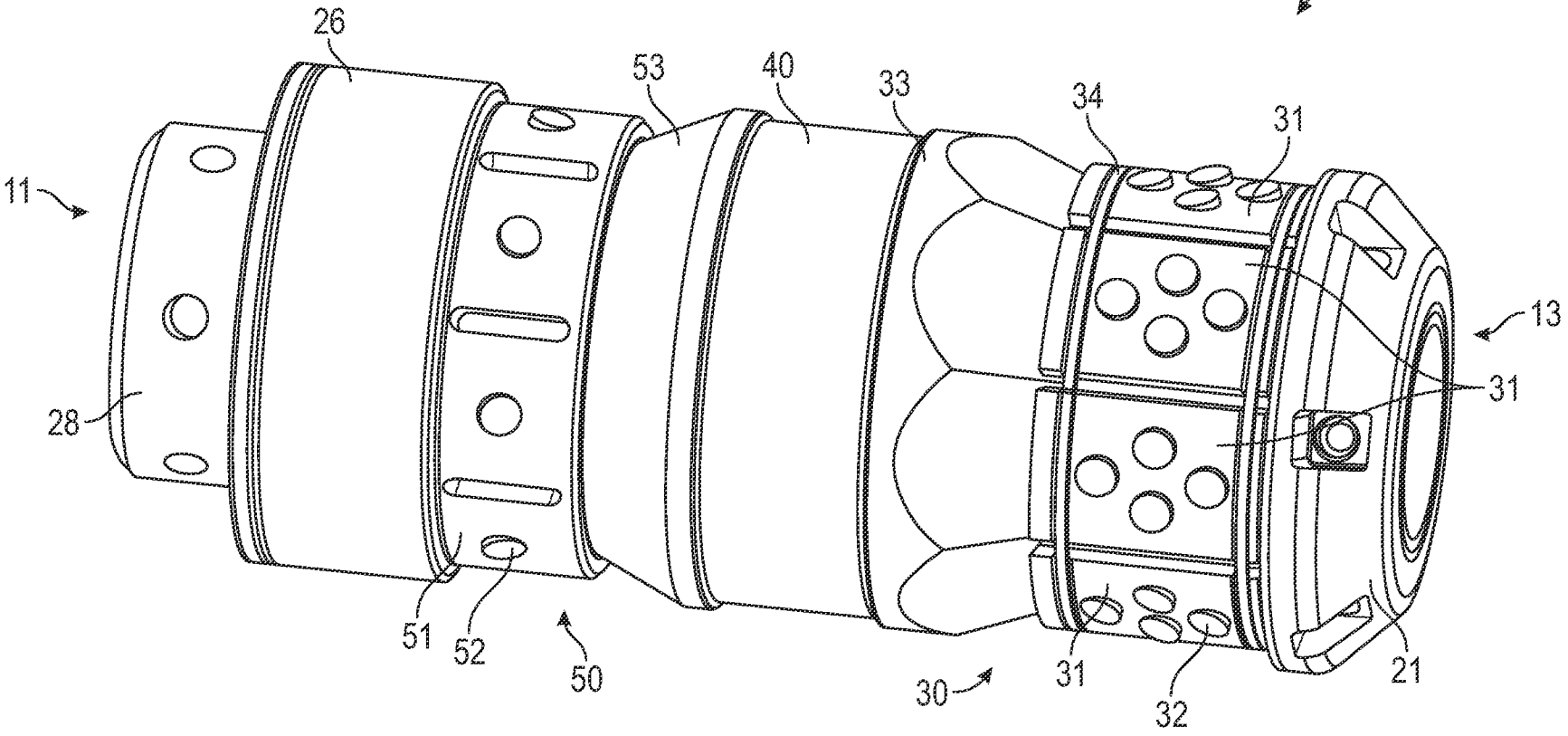
FIG. 2 is a perspective view of an embodiment of a frac plug according to some embodiments.
Figure 3:
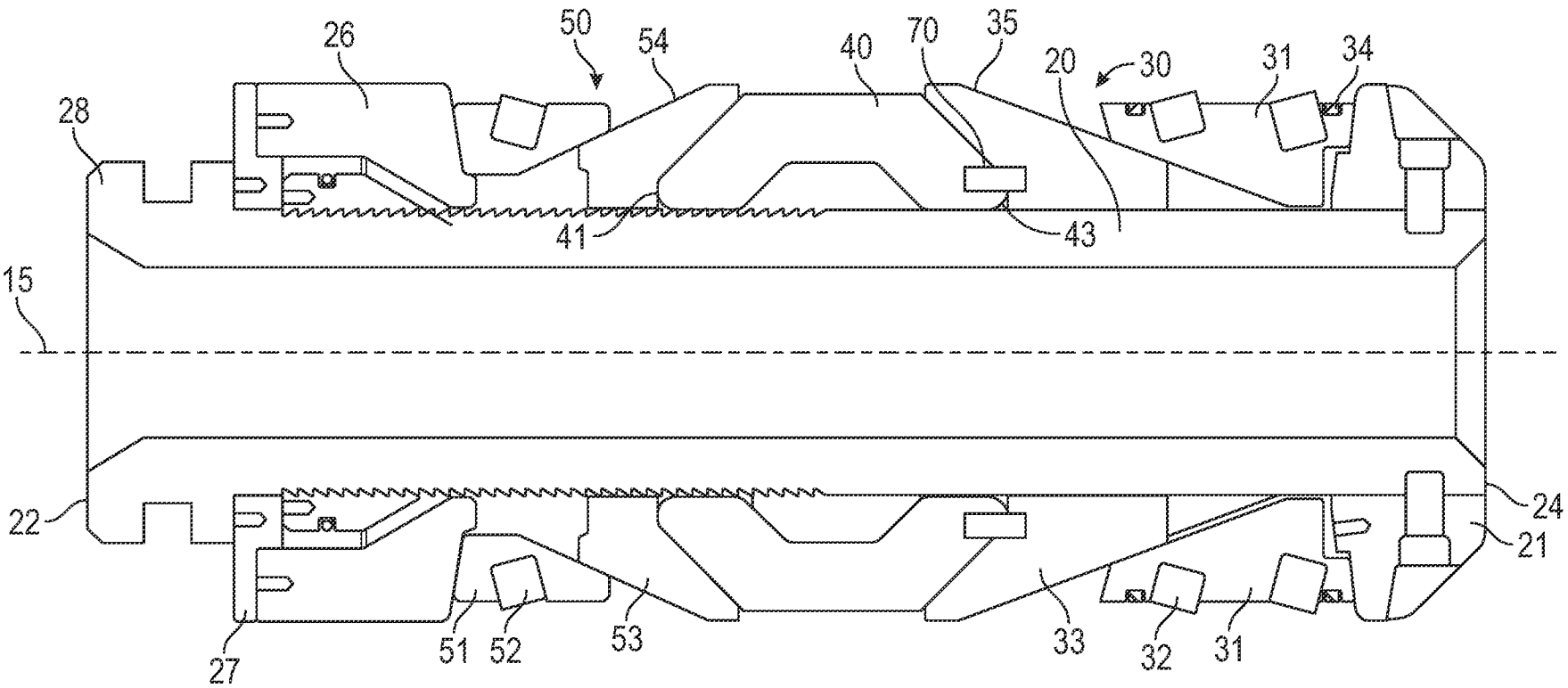
FIG. 3 is an elevation cross-section view of the frac plug of FIG. 2.

Turning now to FIGS. 2 and 3, an embodiment of the frac plug 10 is shown. Initially, it may be understood that the frac plug 10 shown in FIGS. 2 and 3 may be utilized in toolstrings which vary in configuration from the toolstring 5 shown in FIG. 1 and toolstring 5 is only meant to serve as an example illustrating the functionality of frac plug 10. Frac plug 10 extends longitudinally between an uphole end 11 and an opposing downhole end 13. The downhole end 13 of the plug 10 is at the right of FIGS. 2 and 3 and in this exemplary embodiment is defined by a nose 21 of the plug 10 which is first inserted into the wellbore 3. Plug 10 is coupled or appended to a downhole end of the toolstring 5 by a mandrel collar 28 of the plug 10 defining the uphole end 11 of plug 10. While nose 21 is shown as conical (e.g., forming a nose cone) in FIGS. 2 and 3, it may be understood that the shape of nose 21 may vary in other embodiments.

Between ends 11 and 13 of plug 10 is an annular sealing element 40 which may comprise rubber, polymer, and/or other flexible materials. Sealing element 40 extends between a longitudinal first or uphole end 41 and a longitudinal second or downhole end 43 opposite uphole end 41. Along ends 41 and 43 of the annular sealing element 40 are two slip assemblies including a bottom or downhole slip assembly 30 and a top or uphole slip assembly 50. Each slip assembly 30 and 50 includes a slip members or belt arrangement where uphole slip assembly 50 includes a continuous slip ring 51 and the downhole slip assembly 30 includes a number of circumferentially spaced downhole slip segments 31.

In addition, plug 10 also includes an annular slip adapter or compression ring 26 which rides externally on an elongate mandrel 20 (shown in FIG. 3) of the plug 10 which extends between a longitudinal first or uphole end 22 (defined by mandrel collar 28) and an opposed longitudinal second or downhole end 24 that is coupled to nose 21. Compression ring 26 is forced downhole toward the nose 21 by a setting tool (not shown) of the toolstring 5 for longitudinally compressing the slip assemblies 30 and 50 of plug 10 along with the annual sealing element 40 of plug 10 positioned therebetween. Ultimately the plug 10 is shifted from an initial or run-in configuration (shown in FIGS. 2 and 3) to a second or set configuration (shown in FIG. 4, as will be discussed further herein) as the plug 10 is set and locked in place in the casing 2 of the wellbore 3 by making these components grow or expand in diameter to engage with, bite into and seal against casing 2.

In some embodiments, plug 10 comprises a hybrid dissolvable plug having at least some dissolvable components configured to dissolve within the casing 2 after desired period of time. For example, in some embodiments, plug 10 includes components that are formed of at least one of a magnesium alloy and an aluminum alloy to dissolve in the casing 2. In certain embodiments, the mandrel 20 and the nose 21 are formed from dissolvable materials while the remainder of the plug 10 is formed from non-dissolvable materials.

The mandrel 20 of plug 10 extending along a central or longitudinal axis 15. The sealing element 40 is made of a rubber or elastomeric material in this exemplary embodiment, and as can be seen in FIG. 3, axially overlies the mandrel 20 with a shape that extends or bulges outwards towards the casing 2 when compressed or squeezed axially or longitudinally. The squeezing forces imposed on the sealing element 40 are delivered by a setting tool of toolstring 5 that is not shown, but is well known in the art to connect to and hold the mandrel collar 28 in position while a sleeve is pressed against compression ring 26 (e.g., against a setting plate 27 of compression ring 26) of plug 10. As the compression ring 26 is driven downhole toward the nose 21 of plug 10 by the setting tool, compression ring 26 presses axially against an uphole face of the uphole slip ring 51 which itself presses axially against an uphole extrusion ring or cone 53 of plug 10. It should be noted that in this exemplary embodiment the interface formed between the uphole slip ring 51 and the uphole extrusion ring 53 is ramp shaped so that the uphole slip ring 51 is stretched circumferentially as it rides outwardly up a faceted inclined (e.g., frustoconical) radially outer surface 54 of the uphole extrusion ring 53. In this exemplary embodiment, in addition to uphole extrusion ring 53, plug 10 includes a second or downhole extrusion ring or cone 33 located longitudinally between sealing element 40 and the nose 21 of plug 10. Downhole extrusion ring 33 includes a faceted radially outer surface 35 which defines a plurality of circumferentially spaced inclined surfaces. In this arrangement, both extrusion rings 33 and 53 are located external the mandrel 20 such that rings 33 and 53 extend annularly about the mandrel 20 It may also be noted that thus far in the process of setting the plug 10 in the casing 2 of the wellbore 3 the mandrel 20 and nose 21 generally remain in place while the other components that are carried by the mandrel 20 all move progressively downhole toward the nose 21 at the downhole end 24 of the mandrel 20.

Figure 4:
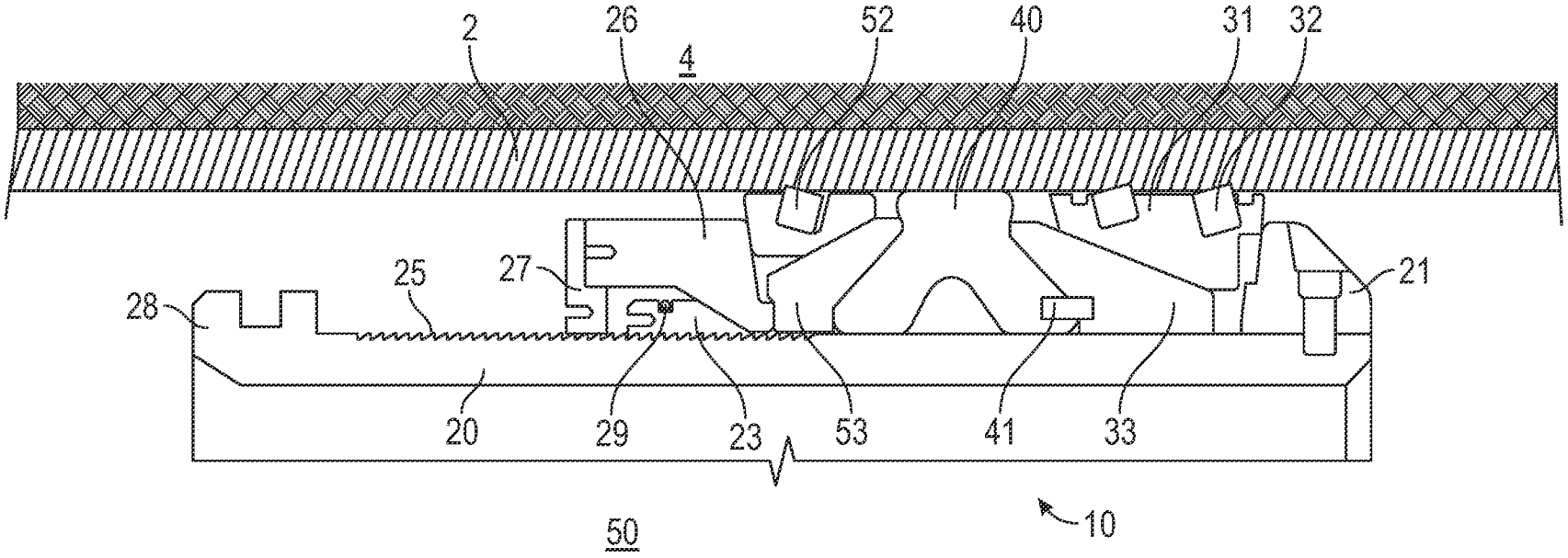
FIG. 4 is a fragmentary cross-sectional view of the frac plug of FIG. 2 set in a casing string according to some embodiments.

Turning now to FIG. 4, the plug 10 is shown in the set configuration where the longitudinal length of annular sealing element 40 has been considerably reduced (e.g., through squeezing) and is bulged or extruded radially outwards against the casing 2. Particularly, the uphole extrusion ring 53 presses longitudinally against the uphole end 41 of sealing element in a first longitudinal direction (e.g., a downhole direction) at the same time as the downhole extrusion ring 33 of plug 10 presses longitudinally against the downhole end 43 of sealing element 40 in an opposing longitudinal direction (e.g., an uphole direction) thereby forcing sealing element 40 to extrude radially outwards towards the casing 2. In addition, the pressing of sealing element 40 against downhole extrusion ring 33 of plug 10 forces downhole slip segments 31 to ride uphole and over a ramped outer surface of downhole extrusion ring 33, pressing downhole slip segments 31 radially outwards and into engagement with the casing 2. Note that the downhole slip segments 31 are abutted against the nose 21 so, while downhole slip segments 31 experience substantial longitudinal compression, downhole slip segments 31 do not move any meaningful amount axially along the mandrel 20 as compared to the remaining mandrel carried components (e.g., extrusion rings 33, 53, sealing element 40). In FIG. 4, the compression ring 26 has been transported downhole and well away from the mandrel collar 28. In this exemplary embodiment, each of the slips 31 and 51 have buttons 32 and 52 (e.g., formed from ceramic or other sufficiently hard and wear resistant materials), respectively, that are set at an angle so that their top edge tends to bite into the casing 2. In this configuration, downhole ceramic buttons 32 bite into the casing 2 in a way to strongly resist downhole movement within the casing. Similarly, the uphole ceramic buttons 52 strongly resist uphole movement of the plug in the event that bottom hole pressure becomes overbalanced with respect to the uphole pressure.

One aspect of the present disclosure is ratchet-shaped setting teeth 25 formed on the periphery or radially outer surface of the mandrel 20. In addition, a Lock ring 23 of plug 10 includes corresponding teeth engaging with the setting teeth 25 to allow downhole movement of the lock ring 23 behind the compression ring 26 while strongly resisting uphole movement by the action and orientation of the setting teeth 25. Moreover, the sloped shapes of the respective contacting faces of the compression ring 26 and lock ring 23 press the teeth of the lock ring 23 deep into the grooves of the setting teeth 25. A ring band 29 of plug 10 is arranged to pull the segments of the lock ring 23 against the periphery of the mandrel, but the force imposed by the compressed setting components of the plug 10 imposed at that sloped face provides greater assurance that the depth to which the setting components are pressed together are maintained once the setting tool has fully stroked and separated from the mandrel collar 28 of plug 10.

Figure 5:
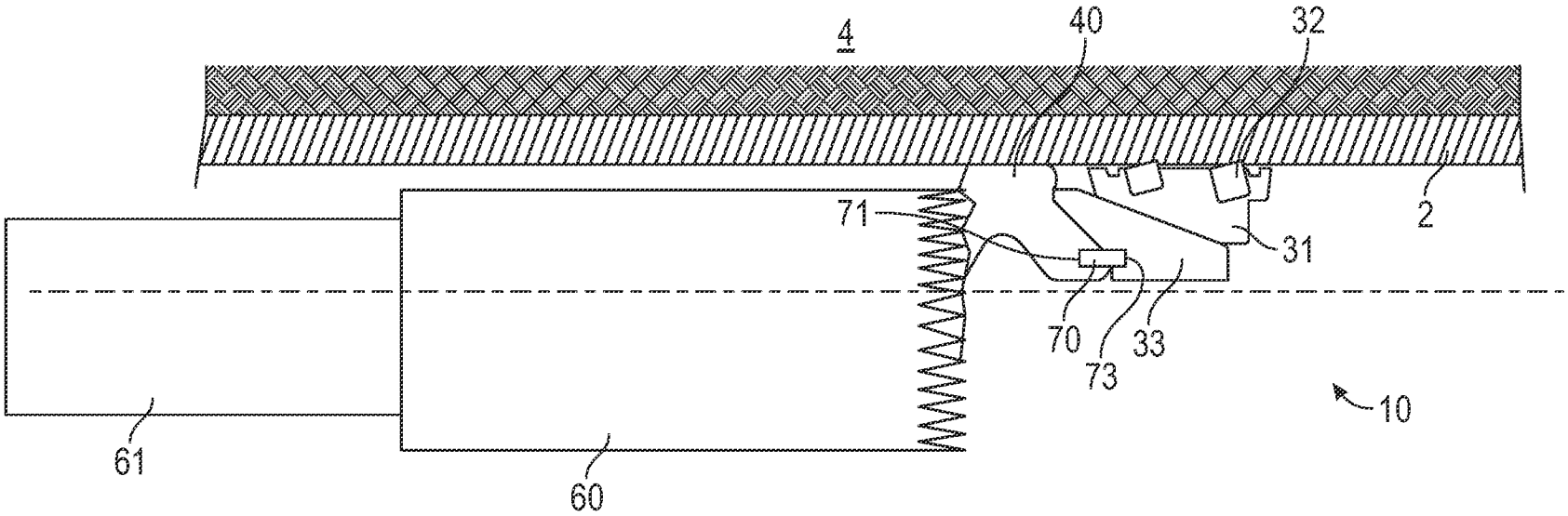
FIG. 5 is a fragmentary cross-sectional view of the frac plug set in the casing string of FIG. 4 being drilled out according to some embodiments.

Turning now to FIG. 5, the plug 10 is shown following the fracking of perforations formed in casing 2 by the one or more perforating guns 7 of toolstring 5. Plug 10 has thus served its purpose with the newly formed perforations successfully fracked such that wellbore 3 may be put into hydrocarbon production. In this example, toolstring 5 may comprise the final toolstring of a series of toolstrings used to perforate casing 2. In order to place wellbore 3 into hydrocarbon production, plug 10 (as well as any other set plugs present in casing 2) must be removed such that a production flowpath may be established extending through the casing 2 to the uphole end thereof.

In this exemplary embodiment, a surface-deployed drill bit 60 is shown in FIG. 5 acting on the annular sealing element 40. As noted above, one of the problems encountered in this process is the annular sealing element 40 bouncing around inside the casing 2 and refusing to be ground up into small bits or debris to be flushed uphole to the surface by the ever-flowing drilling fluid. It may be recognized that the downhole ceramic elements typically remains locked to the casing 2 especially with the drill bit 60 pressing the faceted downhole extrusion ring 33 against the downhole slip segments 31 and thereby pressing the downhole ceramic buttons 32 outward against the casing 2, where these components tend to press back against the drill bit 60. Generally, the present disclosure seeks to use this feature (e.g., the anchored downhole slip segments 31 reacting against the downhole force applied by drill bit 60 against the set plug 10) and extend it to the annular sealing element 40.

Particularly, and referring now to FIGS. 5-7, a plurality of elongate anti-rotation connectors or pins 70 are installed off-axis to resist relative rotation between sealing element 40 and the drill bit 60 such that sealing element 40 may be successfully cut apart by the teeth of the drill bit 60 and subsequently flushed to the uphole end of casing 2. Particularly, connectors 70 are located radially external the mandrel 20 and are circumferentially spaced about the radially outer surface of the mandrel 20 whereby the connectors 70 extend longitudinally directly between sealing element 40 and the downhole extrusion ring 33 of plug 10.

In this exemplary embodiment, connectors 70 are generally cylindrical in shape and extend between a first or uphole end 71 (shown in FIG. 5) and a longitudinally opposed second or downhole end 73 (shown in FIG. 5). The uphole end 71 of each connector 70 is coupled to sealing element 40 (e.g., the downhole end 43 of sealing element 40) while the downhole end 73 of each connector 70 is coupled to the downhole extrusion ring 33. It may be understood that the geometry, configuration, and arrangement of connectors 70 may vary from that shown in FIGS. 5-7 in other embodiments while serving to resist rotation with the drill bit 60. For example, in other embodiments, connectors 70 may not be generally cylindrical in shape. Moreover, in other embodiments, plug 10 may comprise only a single connector directly coupling or attaching sealing element to downhole extrusion ring 33. For instance, in an embodiment, the connector of plug 10 may comprise an annular member or ring coupled directly between sealing element 40 and downhole extrusion ring 33.

Figure 7:
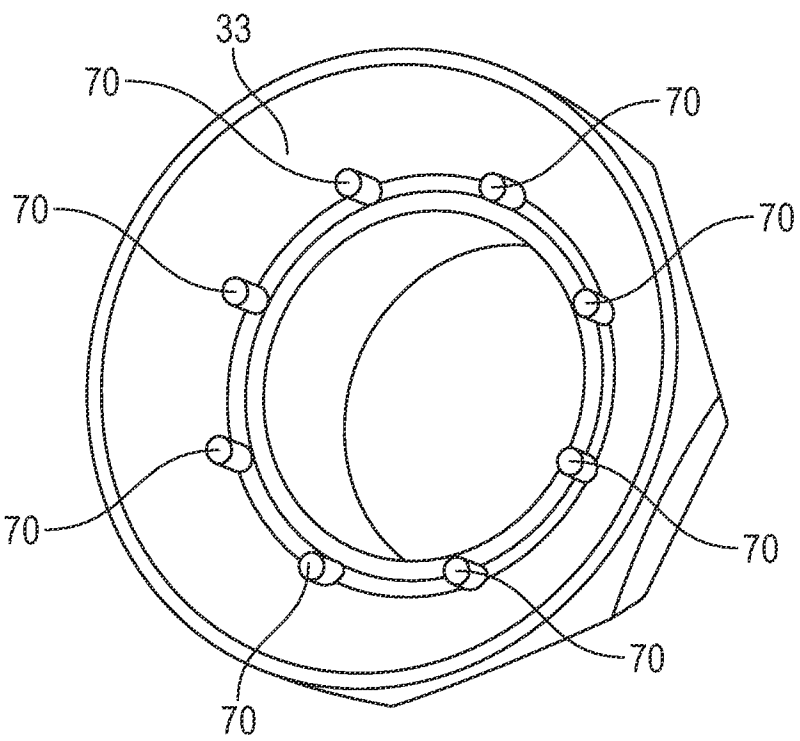
FIG. 7 is a perspective view of an extrusion ring of the frac plug of FIG. 2 according to some embodiments.
Figure 6:
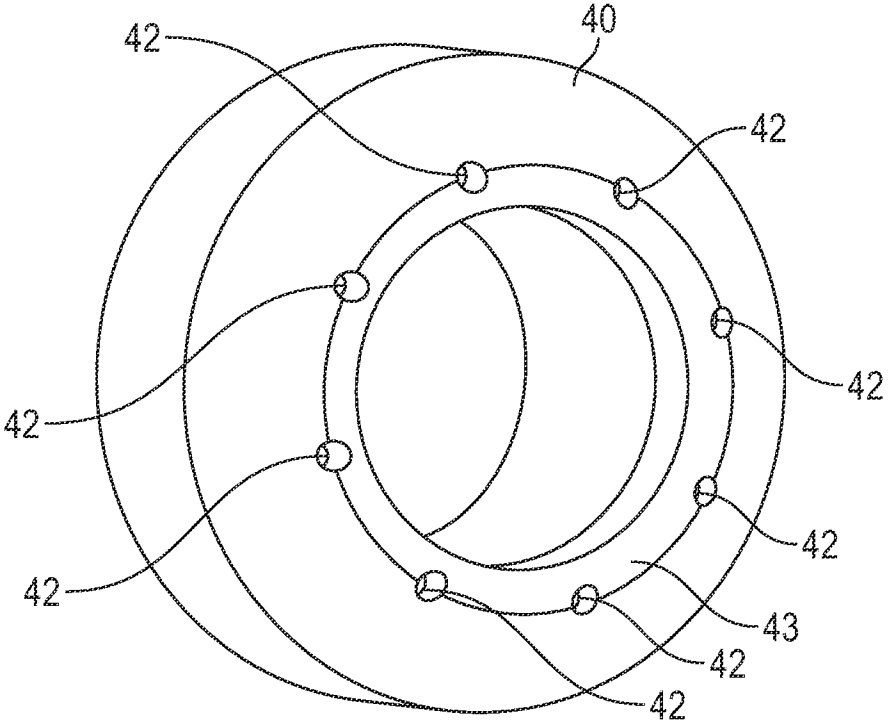
FIG. 6 is a perspective view of a sealing element of the frac plug of FIG. 2 according to some embodiments.

FIGS. 6 and 7 particularly show the annular sealing element 40 and faceted downhole extrusion ring 33 with the connectors 70 and a corresponding set of circumferentially spaced connector bores or receptacles 42 formed in the downhole end 43 of sealing element 40 offset from central axis 15. In this configuration, the uphole ends 71 of connectors 70 are received in the corresponding plurality of connector receptacles 42 of sealing element 40 such that the uphole ends 71 of connectors 70 are received within the sealing element 40 such that connectors 70 extend directly from the downhole extrusion ring 33 to the sealing element 40.

As shown in FIGS. 6 and 7, each of the sealing element 40 and downhole extrusion ring 33 has a ring-like shape to fit or ride on the mandrel 20 via a through hole or throughbore formed in the sealing element 40 and downhole extrusion ring 33. It is noted that this exemplary arrangement has a faceted downhole extrusion ring 33 but other rotation resistant forms such as splines, channels, grooves or other form may be employed. Additionally, in this exemplary embodiment, connectors 70 are formed integrally or monolithically with the downhole extrusion ring 33. However, in other embodiments, connectors 70 may be formed separately from the downhole extrusion ring 33 and later coupled therewith when assembling plug 10. For instance, the downhole ends 73 of connectors 70 may be received within corresponding connector receptacles formed in the uphole end of the downhole extrusion ring 33.

In another aspect of the present disclosure, the annular sealing element 40 may, in some instances, also be adhesively bonded to the faceted downhole extrusion ring 33 so the combination of connectors 70 and the adhesive anchor the annular sealing element 40 to the faceted downhole extrusion ring 33. In some instances, some adhesives (e.g., certain epoxies) alone may serve the purpose such that plug 10 does not include connectors 70.

It should be noted that the faceted surface 35 of the downhole extrusion ring 33 ensures that each of the downhole slip segments 31 are firmly pressed into the casing 2 via the plurality of circumferentially spaced inclined surfaces defining the faceted surface 35 each of which engage a radially inner surface or face (which is similarly inclined in this exemplary embodiment) of a corresponding downhole slip segment 31. Unlike a frustoconical surface, the inclined, planar surfaces defining faceted surface 35 resists relative rotation between the downhole extrusion ring 33 and the downhole slip segments 31. Conversely, the uphole extrusion ring 53 includes a frustoconical surface 54 instead of a faceted surface and although friction may sufficiently lock the uphole slip ring 51 in place for purposes of being drilled out, the faceted surface 35 provides extra assurance that the sealing element 40 and the downhole extrusion ring 33 will resist rotation as the drill bit 60 drills out the plug 10.

For clarity, it should be noted that the process of setting the plug 10 includes a step like process where as a longitudinal force is initially imposed the slip bands 34 are the first to fail allowing the downhole slip segments 31 to ride up the faceted surface 35 of the downhole extrusion ring 33 to engage the inner surface of the casing 2. Meanwhile the uphole slip ring 51 remains intact radially spaced from the inner surface of the casing 2 while the setting compression ring 26 progresses downhole along the mandrel 20. The downhole travel of compression ring 26 relative to mandrel 20 causes the annular sealing element 40 to bulge or extrude outwardly between the pair of extrusion rings 33 and 53 whereby the sealing elements 40 seals against the inner surface of the casing 2.

In this exemplary embodiment, the final two steps of drilling out the set frac plug 10 using the drill bit 60 are the breaking of the uphole slip ring 51 where the inclined surface 54 of uphole extrusion ring 53 presses the uphole ceramic buttons 52 of uphole slip ring 51 into the inner surface of the casing 2 biting and locking therein, followed by the failure of one or more shear members or pins (not shown) that hold the setting tool to the mandrel collar 28. It may be understood that this process is not instantaneous, but is accomplished in a few seconds. With the delayed setting of the uphole slip ring 51 after the setting of the downhole slip segments 31, it is more likely that the ceramic buttons 32 are not dragged backwards from the orientation at which they best bite and hold against the casing 2. Such early setting of both slips 31 and 51 tends to weaken the bite that the plug 10 as a whole has at the desired position in the casing 2.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure presented herein. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

The invention claimed is:

1. A plug deployable into a wellbore extending through a subterranean earthen formation to isolate a downhole section of the wellbore from an opposing uphole section of the wellbore, the plug comprising:

an annular sealing element extending between a pair of longitudinally opposed ends and configured to extend radially outwards into sealing engagement with a wall of the wellbore in response to the plug transitioning from a run-in configuration to a set configuration;

a slip assembly coupled to the sealing element and configured to attach to the wall of the wellbore in response to the plug transitioning from a run-in configuration to a set configuration, wherein the slip assembly comprises one or more radially displaceable slip members and an extrusion ring having a radially inclined outer surface configured to drive the one or more slip members radially outwards and into engagement with the wall of the wellbore in response to the plug transitioning from a run-in configuration to a set configuration; and one or more connectors radially spaced from a central axis of the plug, each of the one or more connectors extending longitudinally from a first end coupled with and contacting the sealing element and a second end coupled with and contacting the extrusion ring of the slip assembly, wherein each of the one or more connectors comprises an elongate pin extending between longitudinally opposed ends.

2. The plug according to claim 1, wherein each of the one or more connectors are formed monolithically with the extrusion ring.

3. The plug according to claim 1, wherein each of the one or more connectors are partially received in one or more corresponding receptacles formed in the extrusion ring.

4. The plug according to claim 1, wherein each of the one or more connectors are partially received in one or more corresponding receptacles formed in the sealing element.

5. The plug according to claim 1, wherein one of the longitudinally opposed ends of each of the one or more connectors is received in a corresponding receptacle formed in the sealing element.

6. The plug according to claim 1, further comprising an elongate mandrel extending between a longitudinal uphole end and a longitudinal downhole end, wherein the one or more connectors are positioned external the mandrel.

7. The plug according to claim 6, further comprising a plurality of the connectors circumferentially spaced about the mandrel.

8. A plug deployable into a wellbore extending through a subterranean earthen formation to isolate a downhole section of the wellbore from an opposing uphole section of the wellbore, the plug comprising:

an elongate mandrel extending between a longitudinal uphole end and a longitudinal downhole end;

an annular sealing element positioned along a radially outer surface of the mandrel and configured to extend radially outwards into sealing engagement with a wall of the wellbore in response to the plug transitioning from a run-in configuration to a set configuration;

a slip assembly positioned along the radially outer surface of the mandrel and configured to attach to the wall of the wellbore in response to the plug transitioning from a run-in configuration to a set configuration, wherein the slip assembly comprises one or more radially displaceable slip members and an extrusion ring having a radially inclined outer surface configured to drive the one or more slip members radially outwards and into engagement with the wall of the wellbore in response to the plug transitioning from a run-in configuration to a set configuration; and one or more connectors positioned radially outwards from and external the mandrel, each of the one or more connectors coupled between the sealing element and the extrusion ring of the slip assembly, wherein each of the one or more connectors comprises an elongate pin extending between longitudinally opposed ends.

9. The plug according to claim 8, further comprising a compression ring coupled to the downhole end of the mandrel whereby relative movement along a central axis of the plug between the mandrel and the compression ring is restricted.

10. The plug according to claim 8, further comprising lock ring positioned about the mandrel and configured to lock the plug in the set configuration.

11. The plug according to claim 8, wherein each of the one or more connectors are formed monolithically with the extrusion ring.

12. The plug according to claim 8, wherein each of the one or more connectors are partially received in one or more corresponding receptacles formed in the extrusion ring.

13. The plug according to claim 8, wherein each of the one or more connectors are partially received in one or more corresponding receptacles formed in the sealing element.

14. The plug according to claim 8, wherein one of the longitudinally opposed ends of each of the one or more connectors is received in a corresponding receptacle formed in the sealing element.

15. The plug according to claim 8, further comprising a plurality of the connectors circumferentially spaced about the mandrel.

* * * * *